US005624358A

United States Patent [19]

Hestilow

[11] Patent Number: 5,624,358

[45] Date of Patent: Apr. 29, 1997

[54] TRAINING BAG APPARATUS

[75] Inventor: Gary Hestilow, Midwest City, Okla.

[73] Assignee: Century Incorporated, Midwest City, Okla.

[21] Appl. No.: 559,351

[22] Filed: Nov. 16, 1995

[51] Int. Cl.[6] ..... A63B 69/36

[52] U.S. Cl. ..... 482/90; 482/83; 482/87

[58] Field of Search ..... 482/83–90, 97; 273/55 A, 26 R

[56] References Cited

U.S. PATENT DOCUMENTS

| | | | |
|---|---|---|---|
| 547,730 | 10/1895 | Maclearn | 482/90 |
| 581,462 | 4/1897 | Hess | 482/90 |
| 2,085,161 | 6/1937 | Kraus | 482/90 |
| 3,521,882 | 7/1970 | Kiernan | 482/90 |
| 4,486,016 | 12/1984 | Rubin | 482/90 |
| 4,903,966 | 2/1990 | Liao | 482/90 |
| 5,330,403 | 7/1994 | Kuo | 482/90 |

OTHER PUBLICATIONS

Advertisement for "Bounce Back Action Dummies", Black Belt Magazine, Oct. 1995, p. 140.

Advertisement for "Bounce–Back Dummy", Martial Arts Supplies Co., Inc., Black Belt Magazine, Oct. 1995, p. 106.

Advertisement for "Huffy Performance Portable Basketball System" and Lifetime Products Transcourt, Service Merchandise catalog, p. 474, date unknown.

Advertisement for "Slam Dunk Systems", Service Merchandise catalog, p. 475, date unknown.

Advertisements for various martial arts equipment, Century Martial Art Supply, Inc. catalog, Fall 1995, pp. 24–30.

*Primary Examiner*—Jerome Donnelly

*Attorney, Agent, or Firm*—Dunlap & Codding, P.C..

[57] ABSTRACT

A training bag apparatus includes a fluid-fillable stand having a pedestal and column supporting a striking pad assembly. The column has a fill opening for filling and emptying the stand. A cap provided to seal the fill opening includes a needle valve for pressurizing the stand. The column of the stand has a pair of channels and lock slots for setting the striking pad assembly to various heights. The striking pad assembly includes a sleeve, a pad disposed around the sleeve and a cover surrounding the exterior of the sleeve and pad. A pair of buttons protrude from the inside wall of the sleeve at locations corresponding to the position of the channels of the column. The sleeve buttons, channels and lock slots cooperate to secure the striking pad assembly at the desired height setting on the column.

18 Claims, 6 Drawing Sheets

TRAINING BAG APPARATUS

BACKGROUND OF THE INVENTION

1. Field of the Invention

The present invention relates to bags and pads which are struck with the hands, arms, feet or legs for conditioning, fitness and technique training in activities such as boxing and the martial arts.

2. Description of Related Art

In the art of boxing, the familiar punching bags, heavy bags and speed bags are well known. These bags are often suspended from overhead chains. A problem with the conventional bags is how to obtain the desired resistance to punches, jabs and kicks and also achieve rapid rebound of the bag.

In the martial arts, pads are sometimes used to receive the punches and kicks. However, the use of pads requires another person in order to train. Further, a person holding a pad may not provide the optimal resistance and rebound to the punches and jabs.

SUMMARY OF THE INVENTION

A training bag apparatus constructed in accordance with the present invention includes a stand and a striking pad assembly. The stand comprises a pedestal supporting a column which carries the striking pad assembly.

The striking pad assembly includes a sleeve and a striking pad which is disposed over the sleeve. The sleeve has an opening which is sized and shaped to receive the column of the stand. With the sleeve placed onto the column of the stand, the striking pad assembly is supported on the stand in a position for being struck with the hands, arms, feet or legs.

One object of the present invention is to provide a training bag apparatus which may be adjusted in its resistance and rebound to punches, jabs and kicks.

Another object of the present invention is to provide a training bag apparatus having a striking pad which is adjustable in height and is replaceable.

Yet another object of the present invention is to provide a training bag apparatus which is portable and useable by one person.

Other objects, features and advantages of the present invention are apparent from the following detailed description when read in conjunction with the accompanying drawings and appended claims.

DETAILED DESCRIPTION OF THE PREFERRED EMBODIMENTS

Figure 1:
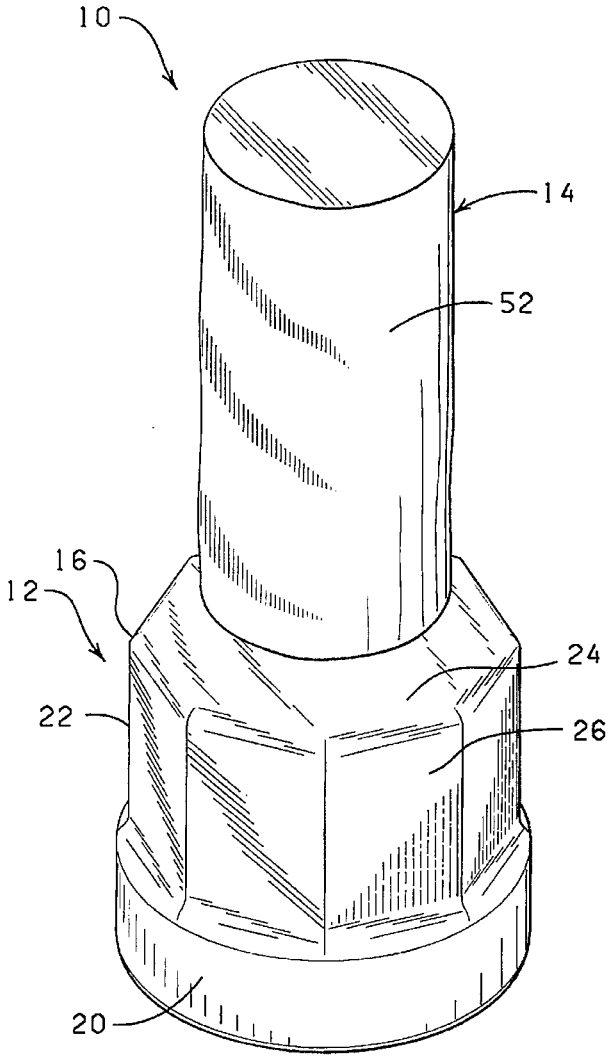
FIG. 1 is a perspective view of a training bag apparatus constructed in accordance with the present invention. The striking pad assembly is in a lowered position.
Figure 2:
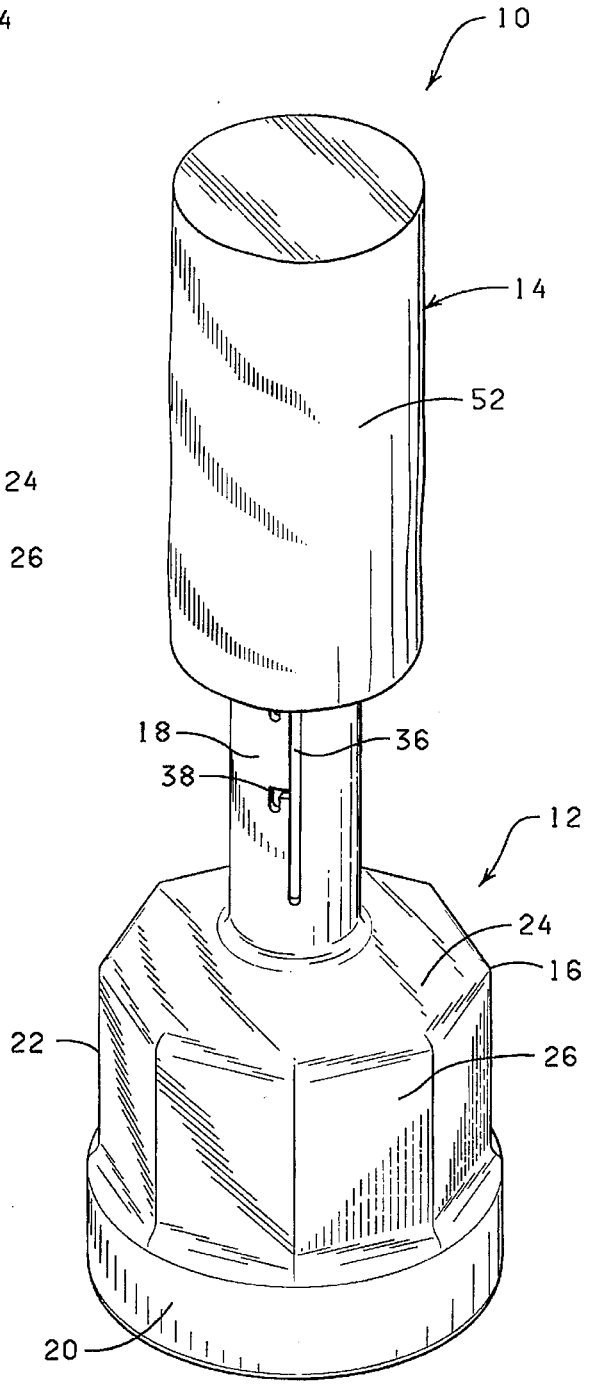
FIG. 2 is the same view as FIG. 1, but the striking pad assembly is in an elevated position.
Figure 3:
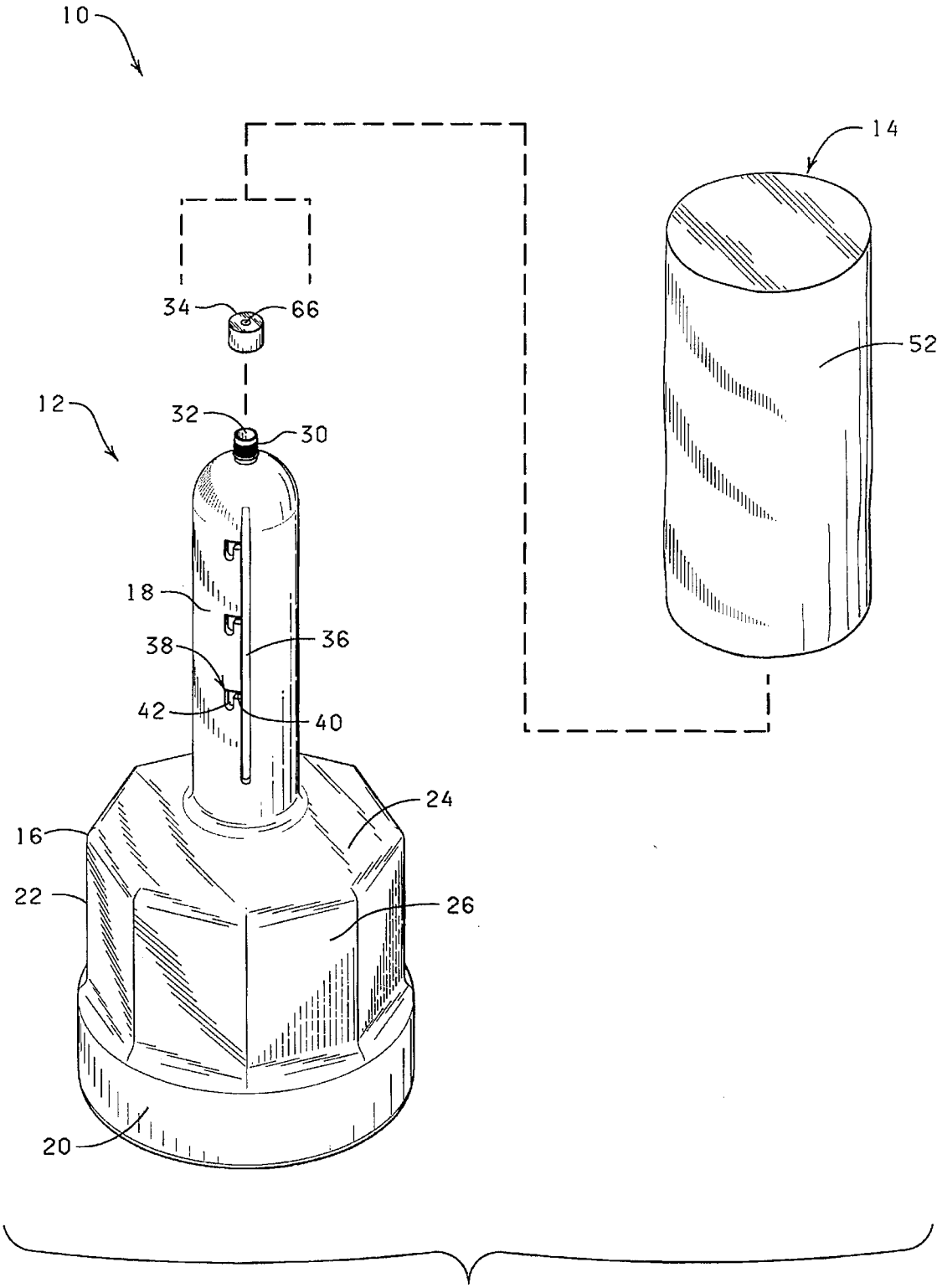
FIG. 3 is an exploded, perspective view of the training bag apparatus shown in FIGS. 1 and 2.

Referring to the drawings in general, and to FIGS. 1 through 3 in particular, shown therein and designated by the general reference numeral 10 is a training bag apparatus, which includes a stand 12 and a striking pad assembly 14. The striking pad assembly 14 is mounted on the stand 12 such that it can be set at a lowered position (FIG. 1), an elevated position (FIG. 2) or at points therebetween.

As best seen in FIG. 3, the stand 12 comprises a pedestal 16 and a column 18. The pedestal 16 has a rounded lower portion 20, a middle portion 22 consisting of a plurality of side panels, and a deck surface 24.

One of the side panels is designated by reference numeral 26 and is generally representative of the side panels in the middle portion 22 of the pedestal 16. The deck surface 24 extends between the upper end of the side panels 26 to the column 18.

Typically, the pedestal 16 has eight side panels 26. However, it should be appreciated that the pedestal 16 may be constructed in a wide variety of geometric shapes without departing from the scope and purpose of the present invention.

As described in detail hereinbelow, the stand 12 is hollow so that fluids may be introduced into the stand 12. A threaded fill collar 30 having a fill opening 32 is provided at the top of the column 18 for putting liquids into the stand 12 and for removing liquids from the stand 12.

Although water is typically used for filling the pedestal 16, it should be appreciated that any suitable substance may be substituted for water. For example, many liquids other than water may utilized. Further, many particulate materials such as sand, gravel, coated or uncoated metallic shot and the like may be placed into the pedestal 16 to give the training bag apparatus 10 stability.

A threaded cap 34 is used to cover the fill opening 32 when the stand 12 is not being filled or drained. It should be appreciated that suitable seals may be provided between the fill collar 30 and the cap 34 such that the stand 12, including the column 18, may contain fluids without leakage.

The column 18 has a pair of longitudinal channels, one of which is visible in FIG. 3 and is designated by reference numeral 36. Typically, the two longitudinal channels 36 are diametrically opposed to one another on the column 18.

Each one of the longitudinal channels 36 intersects with a plurality of lock slots. In FIG. 3, one of the lock slots is designated by reference numeral 38 and is generally representative of the lock slots extending from the longitudinal channels 36.

Typically, each one of the lock slots 38 is L-shaped and has a lateral leg 40 extending from the corresponding longitudinal channel 36 and a lock leg 42 extending downward and substantially parallel with the corresponding longitudinal channel 36. However, the lock slots 38 may be constructed in a wide variety of shapes consistent with their intended purpose, which is to hold the striking pad assembly 14 at a selected height.

Typically, each lock slot 38 on one side of the column 18 is diametrically opposed to a corresponding lock slot 38 on the opposite side of the column 18. However, various other arrangements of the lock slots 38 may be envisioned within the scope of the present invention.

The striking pad assembly 14 is basically cylindrical in shape and is adapted to slide onto the column 18 of the stand 12 in a manner described hereinbelow. It should be appreciated that the striking pad assembly 14 is provided with a cushioning material to protect the user from injury.

Figure 4:
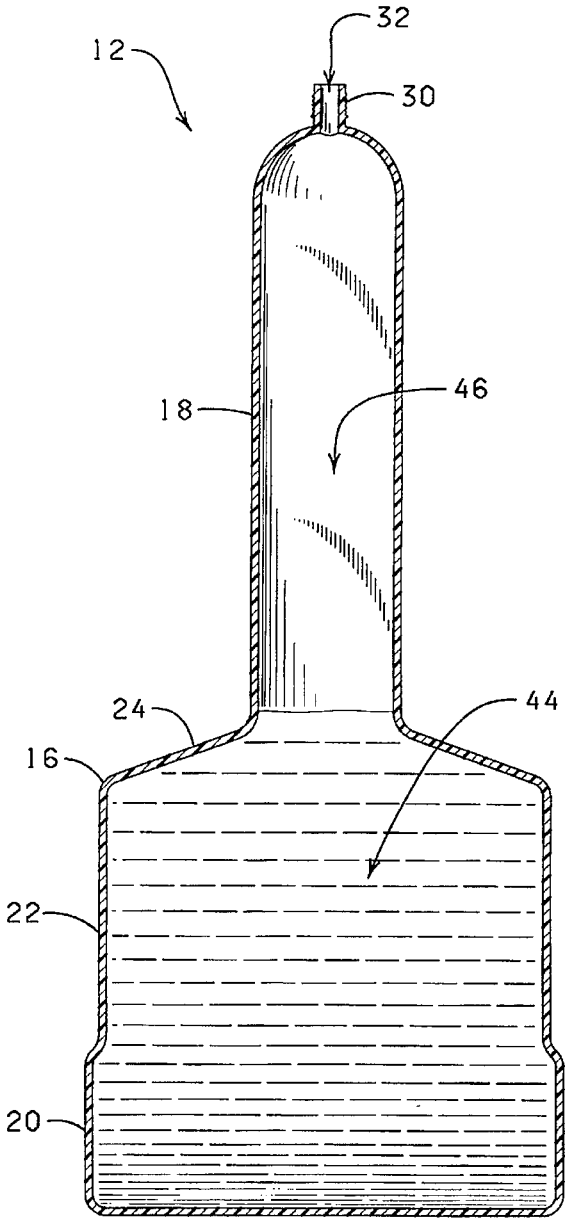
FIG. 4 is a sectional view of the stand of the training bag apparatus.

With reference to FIG. 4, shown therein is the internal construction of the stand 12. As mentioned hereinabove, the stand is hollow such that the pedestal 16 has a pedestal cavity 44 and the column 18 has a column cavity 46. The pedestal cavity 44 and the column cavity 46 communicate with one another and with the fill opening 32 in the top of the column 18.

Preferably, the stand 12 is blow molded from high-density polyethylene. However, the stand 12 may be constructed of any suitable material known in the art through any conventional manufacturing technique.

Prior to use of the training bag apparatus 10, the pedestal cavity 44 is filled with a liquid, such as water. Typically, the pedestal cavity 44 is sized to contain approximately 31 gallons of water, which has a weight affording suitable stability for the stand 12 during use of the training bag apparatus 10.

It should be appreciated that amount of liquid in the stand 12 may be varied in order to adjust the action of the training bag apparatus 10 when the striking pad assembly 14 is struck. Thus, the amount of liquid in the stand 12 may be changed to tailor the resistance and rebound of the training bag apparatus 10 to the conditioning needs or desires of the user.

Figure 5:
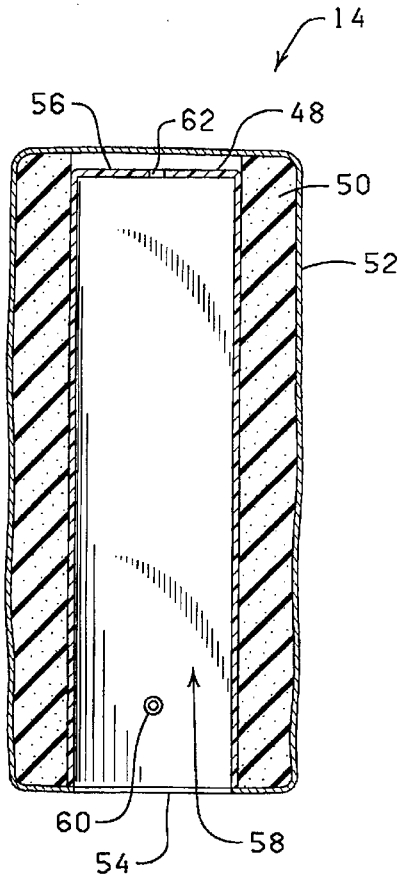
FIG. 5 is a sectional view of the striking pad assembly of the training bag apparatus.
Figure 7:
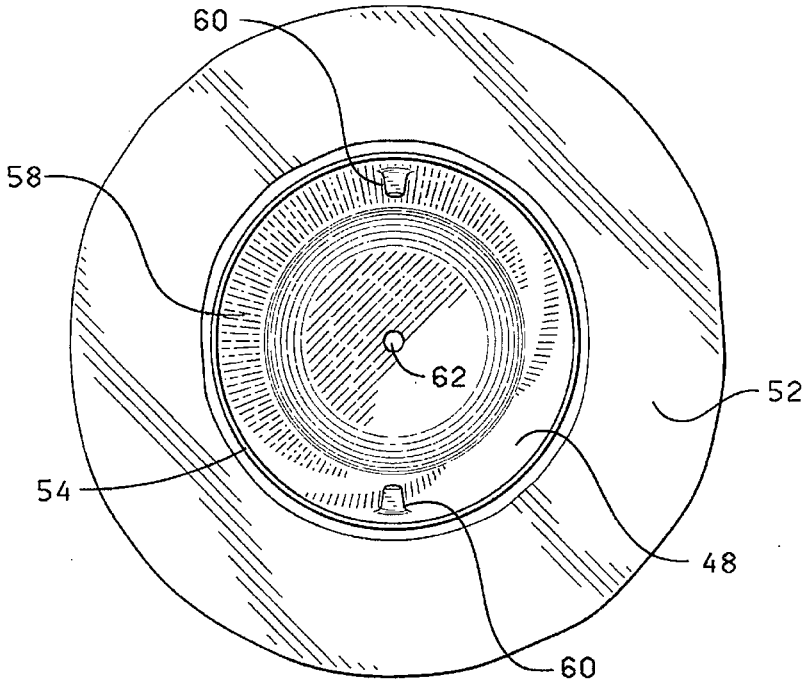
FIG. 7 is a bottom end view of the striking pad assembly of the training bag apparatus.

Referring to FIGS. 5 and 7, shown therein is the detailed construction of the striking pad assembly 14, which comprises a sleeve 48, a cushion 50 and a cover 52. The sleeve 48 is a basically cylindrical tube with an open first end 54 and a second end 56. From its first end 54 to the second end 56, the sleeve 48 defines a sleeve opening 58 which is sized and shaped to receive the column 18 of the stand 12.

As best seen in FIG. 7, a pair of sleeve buttons 60 protrude from the inner wall of the sleeve 48 into the sleeve opening 58. It should be appreciated that the two sleeve buttons 60 are typically diametrically opposed to one another. Further, each sleeve button 60 is sized, shaped and located to protrude into a corresponding one of the longitudinal channels 36 of the column 18 as the sleeve 48 is slipped onto the column 18 of the stand 12.

Typically, the sleeve 48 is 29 inches long and has a diameter of approximately 5.8 inches. The sleeve buttons 60 may be molded as part of the sleeve 48 and located at a distance of about 3 inches from the first end 54 of the sleeve 48.

The second end 56 of the sleeve 48 is closed except for at least one sleeve slot 62. The sleeve slot 62 is provided to allow air between the cover 52 and the second end 56 of the sleeve 48 to pass into the sleeve opening 58. This feature prevents compression of air between the second end 56 of the sleeve 48 and thereby facilitates the installation of the cushion 50 and cover 52 onto the sleeve 48.

The cushion 50 is a cylindrical tube of high density foam rubber. The cushion 50 has a longitudinal bore having an inner diameter which closely matches the outer diameter of the sleeve 48.

Typically, the wall thickness of the cushion 50 is about 3.5 inches. However, it should be appreciated that the cushion 50 may be made in a wide variety of thicknesses. Further, it should be understood that the cushion 50 may be constructed from any suitable material known in the art to have properties consistent with the purpose of the cushion 50.

The cover 52 is a bag-like outer skin which covers the sleeve 48 and cushion 50. Typically, the cover 52 is made of vinyl. However, the cover 52 may comprise any material suitable for use as an outer skin. Suitable materials other than vinyl include, but are not limited to, leather, cowhide and canvas.

Figure 6:
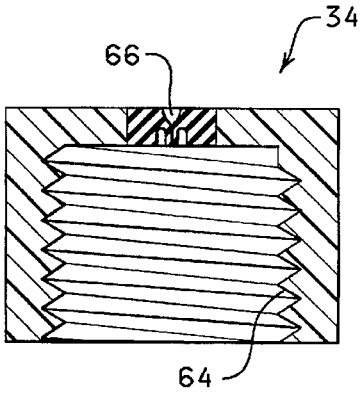
FIG. 6 is a sectional view of the cap for closing the fill opening of the stand of the training bag apparatus.

With reference to FIG. 6, shown therein is the construction of the cap 34. The cap 34 has female threads 64 which threadingly mate with the male threads of the fill collar 30 at the top of the column 18 of the stand 12.

Further, the cap 34 includes an air valve 66 for insertion of an air valve needle so that an air pump may be used to pump air through the cap 34. The construction of such air valves is well known and need not be described in detail.

Typically, the cap 34 is made of high density polyethylene. However, the cap 34 may be constructed of any conventional material suitable for use in making caps or lids.

Setting Up the Training Bag Apparatus

Figure 9:
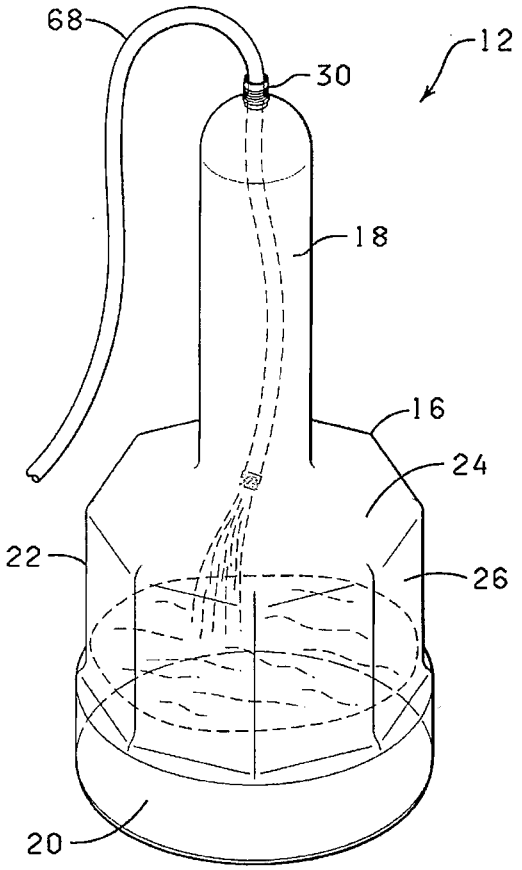
FIG. 9 is a partly diagrammatical, perspective view of the stand of the training bag apparatus wherein water is being introduced into the stand.

In most cases, the training bag apparatus 10 should be set up on a substantially level surface, as close as possible to the selected location of use. As illustrated by FIG. 9, the striking pad assembly 14 and cap 34 are removed to fill the stand 12 with a desired volume of water.

Figure 10:
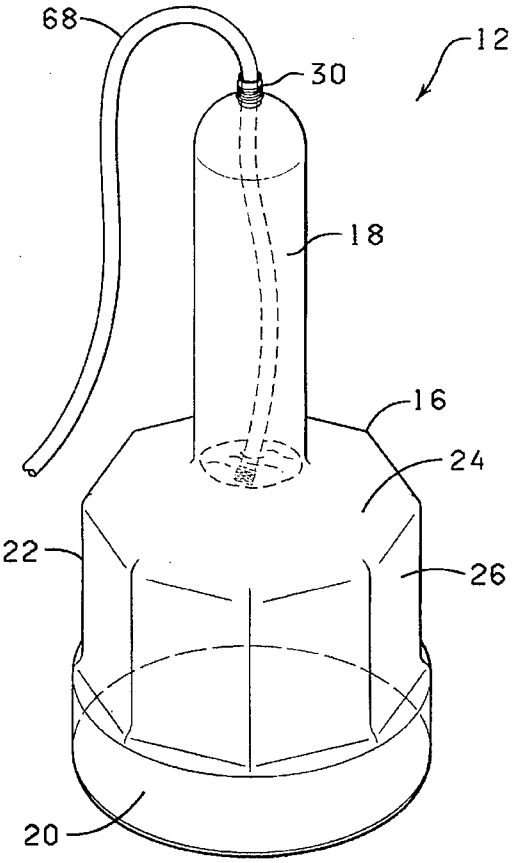
FIG. 10 is the same view as FIG. 9, but with the stand filled with water to a suggested level for use of the training bag apparatus.

A water hose 68 may be inserted into the fill opening 32 at the top of the column 18 of the stand 12. Typically, the stand 12 is filled with water to the level shown in FIGS. 4 and 10.

Next, the cap 34 is screwed onto the fill collar 30 to make the stand 12 fluid-tight. Sealing rings or lubricant may be used in conjunction with the cap 34 to provide a good seal against fluid leakage from the stand 12.

At this point, the water in the stand 12 provides stability, but the column 18 is not pressurized. Thus, the rigidity of the column 18 is due solely to the structural characteristics of the material making up the column 18.

Figure 11:
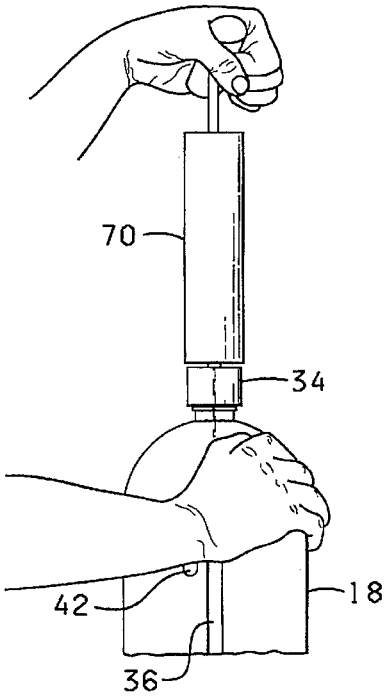
FIG. 11 is side view of an upper portion of the column of the stand to illustrate the use of an air pump to introduce air under pressure into the column to increase the rigidity of the column.

As shown in FIG. 11, the rigidity of the column 18 and stand 12 may be increased by pressurizing the stand 12 with an air pump 70 and inflation needle (not shown) in the manner used to pump up footballs, basketballs and soccer balls. Of course, the inflation needle may be used without the air pump 70 to allow air to escape from the stand 12 and thereby reduce the pressure in the stand 12. In this way, the resistance, rigidity and rebound of the training bag apparatus 10 may be adjusted by increasing or decreasing the pressure in the stand 12.

Once water is added to the stand 12 and the stand 12 is pressurized, the striking pad assembly 14 is mounted onto the column 18 of the stand 12. If the striking pad assembly 14 is not rotated, the each sleeve button 60 slides down the corresponding longitudinal channel 36 until the striking pad assembly 14 rests on the deck surface 24 the stand 12 (FIG. 1). This is the lowermost setting of the training bag apparatus 10.

The striking pad assembly 14 may be set to other heights by sliding the striking pad assembly 14 upward or downward until each one of the sleeve buttons 60 is adjacent to a selected one of the lock slots 38. Then, the striking pad assembly 14 is rotated to position each one of the sleeve buttons 60 into the lateral leg 40 of the respective lock slot 38.

The striking pad assembly 14 falls or may be urged downward such that each one of the sleeve buttons 60 is seated in the lock leg 42 of the respective lock slot 38 to lock the striking pad assembly 14 in position. The highest position of the striking pad assembly 14 is shown in FIG. 2.

It should be appreciated that a variety of height settings may be provided for the training bag apparatus 10. In a typical arrangement, the training bag apparatus 10 has four height settings between 52 and 70 inches from the bottom of the stand 12, in six inch increments.

To move the striking pad assembly 14 to a different height setting, the striking pad assembly 14 is lifted to move the sleeve buttons 60 out of the lock leg 42 and into the lateral leg 40 of the respective lock slot 38. Next, the striking pad assembly 14 is rotated such that each sleeve button 60 slides through the lateral leg 40 of the respective lock slot 38 and into the respective longitudinal channel 36. Then, the striking pad assembly 14 may be raised, lowered or lifted from the column 18 of the stand 12.

Operation of the Training Bag Apparatus

Figure 8:
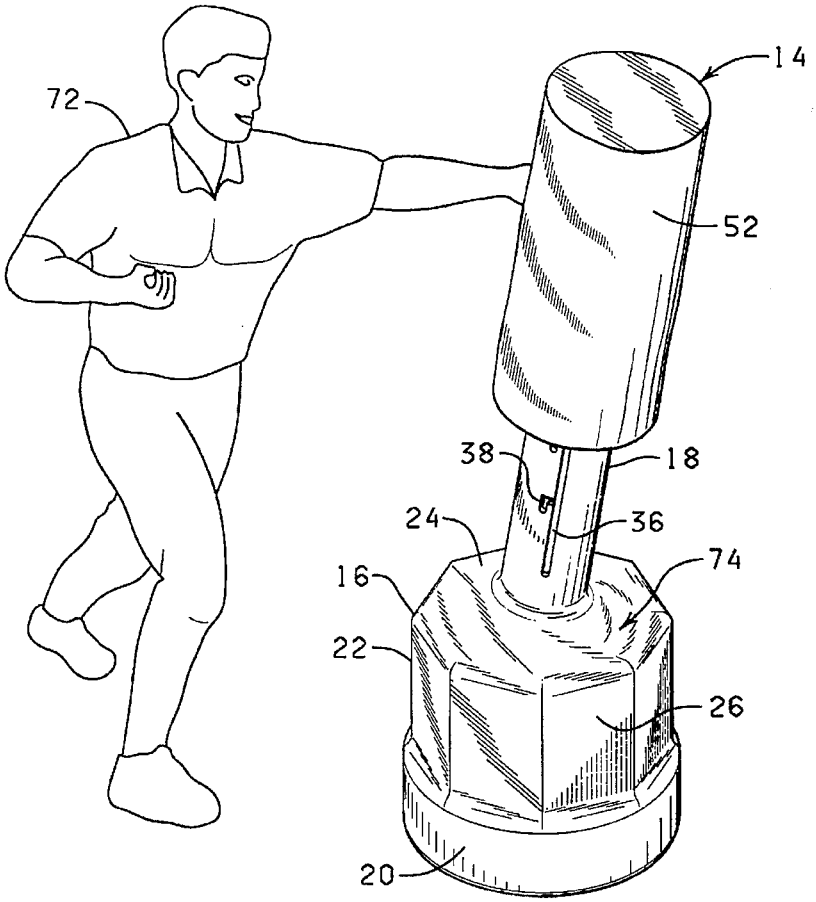
FIG. 8 is a perspective view of the training bag apparatus in use wherein the striking pad has just been struck.

With reference to FIG. 8, shown therein is a person 72 in the act of striking the training bag apparatus. When the striking pad assembly 14 is hit with sufficient force, the column 18 is driven from a vertical position to an angular recoil position.

As indicated by reference numeral 74 in FIG. 8, the recoil of the column 18 is accompanied by an inward deformation of the deck surface 24 on the opposite side of the pedestal 16 from the blow to the striking pad assembly 14. It should be appreciated that the pedestal 16 may even tip from the floor if the striking pad assembly 14 is struck with sufficient force.

The training bag apparatus 10 provides resistance to the blow and rebounds to receive the next blow. The amount of resistance and the rebound speed of the training bag apparatus 10 may be adjusted by changing the air pressure and amount of water in the stand 12.

The characteristics of the training bag apparatus 10 may also be altered by replacing the striking pad assembly 14. Several striking pad assemblies having cushions 50 with differing degrees of firmness or different types of covers 52 may be kept on hand. Since the striking pad assembly 14 may be so easily removed from and mounted on the stand 12, one stand 12 and several differing striking pad assemblies 14 provide a very versatile conditioning and training apparatus.

Draining and Moving the Stand

Figure 12:
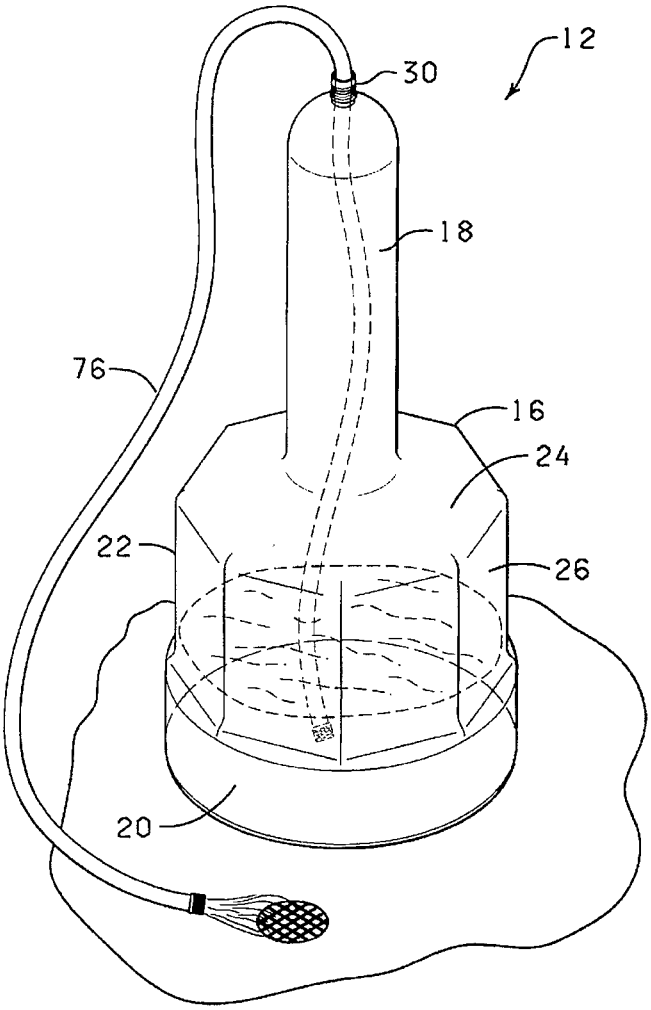
FIG. 12 is a partly diagrammatical, perspective view of the stand of the training bag apparatus wherein water is being siphoned out of the stand.

As shown in FIG. 12, the stand 12 may be drained by siphoning the water out of the stand 12 through a siphoning hose 76. Once the siphoning is completed, the stand 12 is light in weight and may be tipped upside down to allow the last of the water to run out.

Although the training bag apparatus 10 weighs about 270 pounds when properly filled with water, it may be moved without draining the water. For movement over short distances, the stand 12 may be tipped to an angle of about 45 degrees and rolled on the cylindrical lower portion 20 of the stand 12.

For movement over long distances, the stand 12 may be laid down on its side and rolled to the new location. To set the stand 12 back up, the column 18 may be lifted until the stand 12 can be tipped into the upright position.

Pressurizing the Stand with Chemicals

Figure 13:
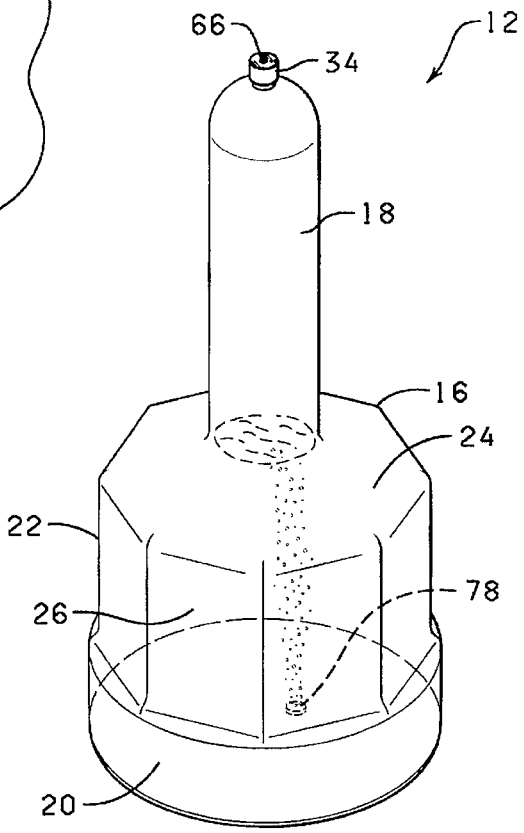
FIG. 13 is a partly diagrammatical, perspective view of the stand of the training bag apparatus wherein the stand is capped and a chemical is being dissolved in the water within the stand to pressurize the column of the stand.

As illustrated by FIG. 13, the stand 12 may be pressurized by adding a chemical 78 to the water. The chemical 78 used may be sodium bicarbonate, sodium sulfate, or like chemicals, or any combination of such chemicals.

The chemical 78 is simply added to the water and the cap 34 is screwed tightly onto the column 18 of the stand 12. Upon exposure to water, such chemicals 78 release a gas to pressurize the stand 12.

In the case of sodium bicarbonate, the stand 12 is pressurized by air and carbon dioxide. Of course, carbon dioxide itself may be injected into the stand 12 in order to pressurize the stand 12.

The resulting pressurization has the same effect as using the air pump to pressurize the stand 12. The pressure increases the rigidity of the stand 12 such that the striking pad assembly 14 rebounds more quickly than when the stand 12 is not pressurized.

It should be appreciated that the training bag apparatus 10 is a self-contained, free-standing, portable unit. Thus, the training bag apparatus 10 eliminates the need for a ceiling hanger or a separate bag stand.

Further, it should be appreciated that conventional training bags weight between 40 and 120 pounds. The striking bag assembly 14 weighs about 5.5 pounds, but provides the same conditioning benefits as the much heavier conventional bags.

Changes may be made in the combinations, operations and arrangements of the various parts and elements described herein without departing from the spirit and scope of the invention as defined in the following claims.

What is claimed is:

1. A training bag apparatus comprising:

a pedestal having an upper end, a lower end, and a deck at the upper end thereof;

a column extending substantially vertically upward from the deck of the pedestal said column and said deck being an integral one piece unit; and a striking pad assembly having a sleeve opening sized and shaped to receive the column such that the pedestal and column support the striking pad assembly for being struck;

wherein at least the deck of the pedestal is flexible to deform when the striking pad assembly is struck and wherein the column is caused to move in a direction away from it's substantially vertical orientation.

2. The training bag apparatus of claim 1 further comprising:

means for adjusting the vertical position of the striking pad assembly upon the column.

3. A training bag apparatus comprising:

a pedestal having an upper end, a lower end, and an inner cavity and a deck at the upper end thereof;

a column extending substantially vertically from the upper end of the pedestal, said column and said pedestal being an integral one piece unit and having an inner cavity communicating with the inner cavity of the pedestal;

means for introducing a fill substance into the inner cavity of the pedestal to weight down the pedestal; and a striking pad assembly having a sleeve opening sized and shaped to receive the column such that the pedestal and column support the striking pad assembly for being struck, wherein at least the deck is flexible to deform when the striking pad assembly is struck, and wherein the column is caused to move in a direction away from it's substantially vertical orientation.

4. The training bag apparatus of claim 2 wherein the fill substance comprises water.

5. The training bag apparatus of claim 2 further comprising:

means for introducing a fluid under pressure into the inner cavity of the column to adjust the rigidity of the column.

6. The training bag apparatus of claim 5 wherein the fluid under pressure comprises air.

7. The training bag apparatus of claim 5 wherein the fluid under pressure comprises carbon dioxide.

8. The training bag apparatus of claim 2 wherein the means for introducing a fill substance comprises a fill opening in the column.

9. The training bag apparatus of claim 8 further comprising:

a cap securable to the column to close the fill opening in the column.

10. The training bag apparatus of claim 9 further comprising:

a needle valve through the cap for pumping air into the inner cavity of the column.

11. A training bag apparatus comprising:

a pedestal having an upper end and a lower end;

a column extending substantially vertically from the upper end of the pedestal, said column and said deck being an integral one piece unit, and having a plurality of longitudinal channels and lock slots, each one of the lock slots intersecting with one of the longitudinal channels of column;

a sleeve having a sleeve opening and a plurality of buttons extending into the sleeve opening, the sleeve opening being sized and shaped to receive the column, each one of the buttons being located for sliding movement within a corresponding one of the longitudinal channels when the sleeve opening receives the column; and a striking pad disposed around the sleeve;

wherein at least the deck is flexible to deform when the striking pad of the bag is struck such that the column, sleeve and striking pad recoil when the pad is struck;

wherein the height of the sleeve and striking pad is adjustable by vertically sliding the sleeve and striking pad such that each one of the buttons is disposed at a selected one of the lock slots and by laterally rotating the sleeve and cushion such that each one of the buttons is moved out of the longitudinal channel and into the selected one of the lock slots.

12. The training bag apparatus of claim 11 wherein the pedestal has an inner cavity.

13. The training bag apparatus of claim 12 further comprising:

means for introducing a fill substance into the inner cavity of the pedestal.

14. The training bag apparatus of claim 13 wherein the fill substance comprises water.

15. The training bag apparatus of claim 11 wherein the column has an inner cavity.

16. The training bag apparatus of claim 15 further comprising:

means for introducing a fluid under pressure into the inner cavity of the column.

17. The training bag apparatus of claim 16 wherein the fluid under pressure comprises air.

18. The training bag apparatus of claim 16 wherein the fluid under pressure comprises carbon dioxide.

* * * * *

UNITED STATES PATENT AND TRADEMARK OFFICE

CERTIFICATE OF CORRECTION

PATENT NO. : 5,624,358

DATED : April 29, 1997

INVENTOR(S) : Hestilow

It is certified that error appears in the above-indentified patent and that said Letters Patent is hereby corrected as shown below:

Column 7, line 14, please delete "2" and substitute therefor --3--.

Column 7, line 16, please delete "2" and substitute therefor --3--.

Column 7, line 25, please delete "2" and substitute therefor --3--.

Signed and Sealed this

Fifth Day of August, 1997

Bruce Lehman

*Attest:*

BRUCE LEHMAN

*Attesting Officer*

*Commissioner of Patents and Trademarks*